US005107075A

United States Patent [19]

Currier, Jr.

[11] Patent Number: 5,107,075

[45] Date of Patent: Apr. 21, 1992

[54] SLIDABLE SAFETY COVER FOR ELECTRICAL OUTLETS

[75] Inventor: Donald J. Currier, Jr., Long Lake, Minn.

[73] Assignee: North States Industries, Inc., Minneapolis, Minn.

[21] Appl. No.: 393,541

[22] Filed: Aug. 11, 1989

[51] Int. Cl.[5] ..... H01R 13/447

[52] U.S. Cl. ..... 174/67; 439/136

[58] Field of Search ..... 174/67; 220/242; 439/136, 140

[56] References Cited

U.S. PATENT DOCUMENTS

| | | | |
|---|---|---|---|
| 2,988,242 | 6/1961 | Kneip | 174/67 X |
| 4,789,347 | 12/1988 | Banjo et al. | 439/140 |
| 4,793,818 | 12/1988 | Poirier | 174/67 X |
| 4,810,833 | 3/1989 | Meyers | 174/67 |
| 4,857,004 | 8/1989 | Poirier | 174/67 X |

*Primary Examiner*—Harold Broome
*Assistant Examiner*—David A. Tone
*Attorney, Agent, or Firm*—Merchant, Gould, Smith, Edell, Welter & Schmidt

[57] ABSTRACT

An improved slidable safety cover for use with electrical outlets is disclosed in which at least one slidable cover member is movably mounted on an apertured stationary frame overlaying an electrical outlet. The slidable cover member is movable between an open position at which access to underlaying electrical outlets is available through the slidable safety cover and a closed position at which access to the electrical outlets is blocked by the slidable cover member. Movement of the slidable cover member from the closed position to the open position requires release of a locking mechanism comprising at least one resilient finger latch member having a first end portion anchored to the stationary frame and a second end portion partially protruding through the slidable cover member. A finger latch opening is provided in the slidable cover member and is located distal from all sides of the safety cover slidable cover member.

11 Claims, 2 Drawing Sheets

SLIDABLE SAFETY COVER FOR ELECTRICAL OUTLETS

FIELD OF THE INVENTION

The present invention relates generally to a slidable safety cover for electrical outlets. More particularly, this invention concerns a slidable safety cover with a locking mechanism comprising at least one resilient finger latch member extending though an aperture centrally located in the slidable safety cover.

BACKGROUND OF THE INVENTION

Within the field of safety covers for electrical outlets there is a variety of mechanisms. These mechanisms typically include means for locking covers over electrical outlets and for selectively releasing the covers to permit access to the electrical outlets. A number of problems exist with these devices relating to the ease with which the locking means may be defeated by unsupervised children playing near or with the electrical outlets. Other known problems relate to outlet safety covers which have attaching means external to the outlet permitting unauthorized access to the outlets, locking means which do not normally bias the cover to a closed position, and outlet covers which are complex and difficult to manufacture and assemble.

What has been needed, therefore, has been a slidable safety cover for electrical outlets with locking means operable to prevent unauthorized opening by children.

What has been further needed has been a slidable safety cover for electrical outlets which is of simple yet durable construction.

Other objects and advantages of the invention will appear from the following detailed description which, in connection with the accompanying drawings, discloses embodiments of the invention for purposes of illustration only and not for determination of the limits of the invention.

SUMMARY OF THE INVENTION

A slidable safety cover for electrical outlets is provided comprising a stationary frame for installation around an electrical outlet. The stationary frame comprises a front surface and a rear surface defining apertures extending through the stationary frame for preventing access to electrical outlets therethrough. Biasing means are positioned on the stationary frame for biasing slidable component means. Slidable component means are provided which are constructed and arranged for selective slidable movement on the stationary frame between an open position at which access to the electrical outlets is available through the safety cover and a closed position at which access to the electrical outlets is blocked. The slidable component means preferably comprises at least one slidable cover member having an outer surface, an inner surface, and side surfaces. The slidable cover member inner surface comprises at least one positioning tab constructed and arranged for contact by the biasing means so that the biasing means applies force against the positioning tab to normally bias the slidable cover member toward the closed position. Also, the slidable cover member inner surface and outer surface define an aperture therethrough comprising a finger latch opening located between the side surfaces. A locking mechanism is provided comprising at least one resilient finger latch member having a first end portion anchored to the front surface of the stationary frame and a second end portion shaped to partially protrude through the slidable cover member finger latch opening when the slidable component means is in the closed position so that the slidable component means is immovable. The resilient finger latch is also constructed and arranged so that when the resilient finger latch second end portion is depressed and the force of the biasing means against the positioning tab is overcome, then the locking mechanism is released to permit slidable movement of the slidable component means to the open position.

DETAILED DESCRIPTION OF THE INVENTION

As required, detailed embodiments of the present invention are disclosed herein. It is to be understood, however, that the disclosed embodiments are merely exemplary of the invention which may be embodied in various forms. Therefore, specific structural and functional details disclosed herein are not to be interpreted as limiting, but rather as a basis for teaching one skilled in the art to variously employ the present invention in virtually any appropriately detailed system or structure.

Figure 1:
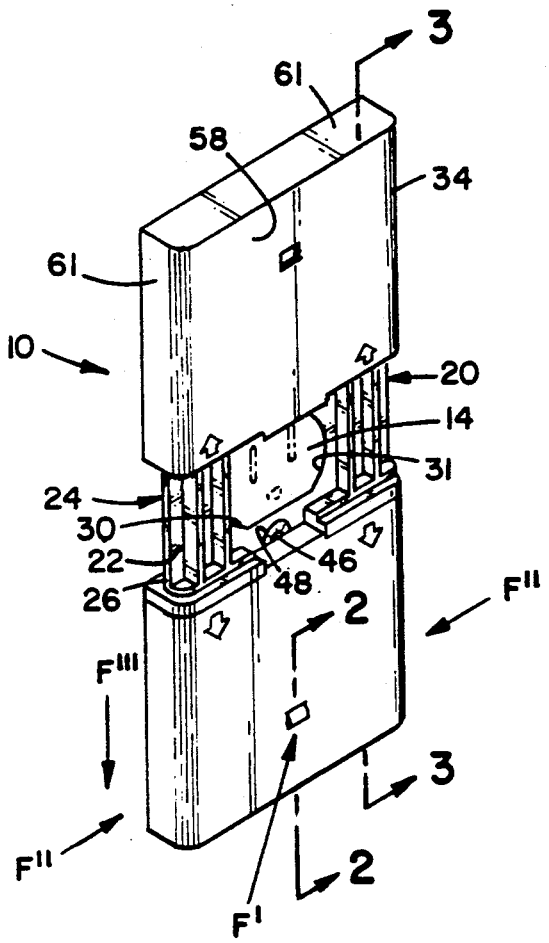
FIG. 1 is a front elevation perspective view of a partially opened slidable safety cover positioned over an electrical outlet station.

Referring to FIG. 1, a preferred slidable safety cover 10 according to the present invention is shown. Slidable safety cover 10 is constructed and arranged for mounting at an electrical outlet station to provide means for selectively covering the electrical outlets, such as outlet 14 shown in FIG. 1. Typically, electrical outlets 14 are constructed and arranged as shown, however, it is understood that the shape of electrical outlet 14 is representative only and slidable safety cover 10 may be appropriately reshaped as necessary to achieve the advantages of the present invention with virtually any electrical outlet of various shapes. As further illustrated in FIG. 1, slidable safety cover 10 comprises a stationary frame 20 for installation around electrical outlet 14 or, more preferably, around an electrical outlet station comprising a plurality of electrical outlets 14. Stationary frame 20 comprises a front surface 22 and a rear surface 24. Front surface 22 and rear surface 24 define at least one aperture 30 extending through stationary frame 20 for permitting access to electrical outlet 14 therethrough. Stationary frame 20 preferably also comprises guide surface flange means 26 for guiding slidable component means thereon.

Preferred slidable safety cover 10 comprises slidable component means including at least one slidable cover member 34 arranged in cooperative slidable relation on stationary frame 20. Biasing means are provided, preferably internal of slidable safety cover 10, for operatively biasing slidable cover member 34 to a normally closed position at which access to electrical outlets 14 is blocked by the surface area of slidable cover member 34. Accordingly, preferred slidable safety cover 10 provides means for denying access to the potentially hazardous electrical shock of electrical outlet 14 by unauthorized individuals, such as children or others unable to appreciate the danger inherent in electrical outlets.

Safety covers for electrical outlets are well known and have many varieties. However, prior safety covers have not effectively achieved the desired combinations of selective access denial and manufacturing and assembly simplicity. Preferred slidable safety cover 10 and embodiments thereof within the present invention achieve these desirable goals to provide an improved safety cover for electrical circuits comprising a slidable safety cover with an exemplary locking mechanism as shown in FIG. 2 and as further described herein.

Figure 2:
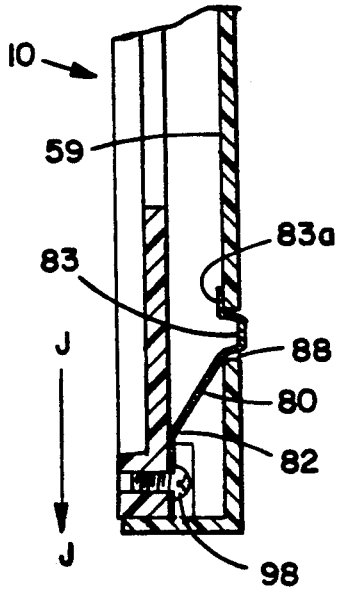
FIG. 2 is a side sectional view along lines 2—2 of the slidable safety cover locking mechanism shown in FIG. 1.
Figure 3:
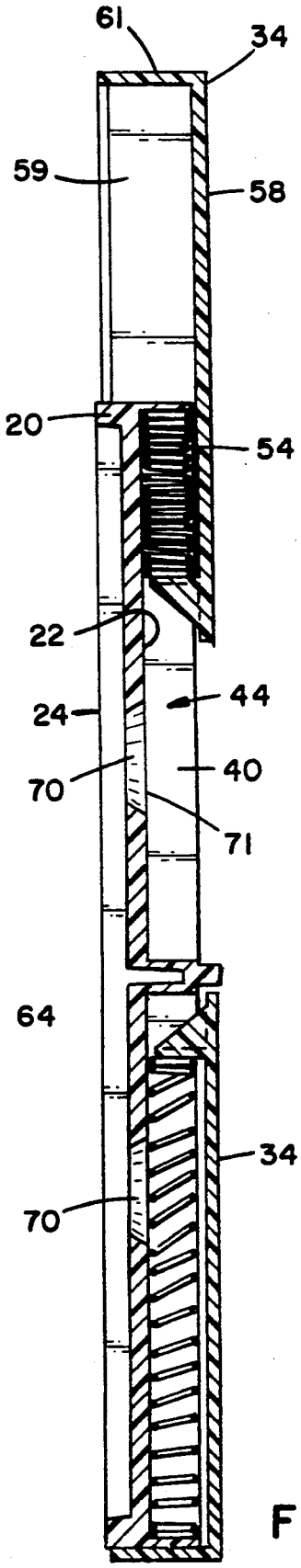
FIG. 3 is a side sectional view along lines 3—3 of the slidable safety cover shown in FIG. 1.

Referring now to FIG. 1, FIG. 2, and FIG. 3, greater detail of preferred slidable safety cover 10 will be discussed. Preferred slidable safety cover 10 comprises a stationary frame 20 comprising front surface 22 and rear surface 24. Stationary frame 20 front and rear surfaces define apertures 30 having sidewalls 31 extending through stationary frame 20 for permitting access to electrical outlets underlaying the stationary frame. Front surface 22 of stationary frame 20 also comprises means for receiving biasing means, and more preferably comprises channel means to receive a biasing means therein. Preferred channel means comprises a plurality of parallel sidewalls 40 extending normal to the plane of front surface 22 (the vertical plane when installed vertically as shown in FIG. 1 or the horizontal plane when viewed as in FIG. 4) and preferably arranged longitudinally along front surface 22 to provide at least one elongate channel 44 for receipt of biasing means therein.

Figure 4:
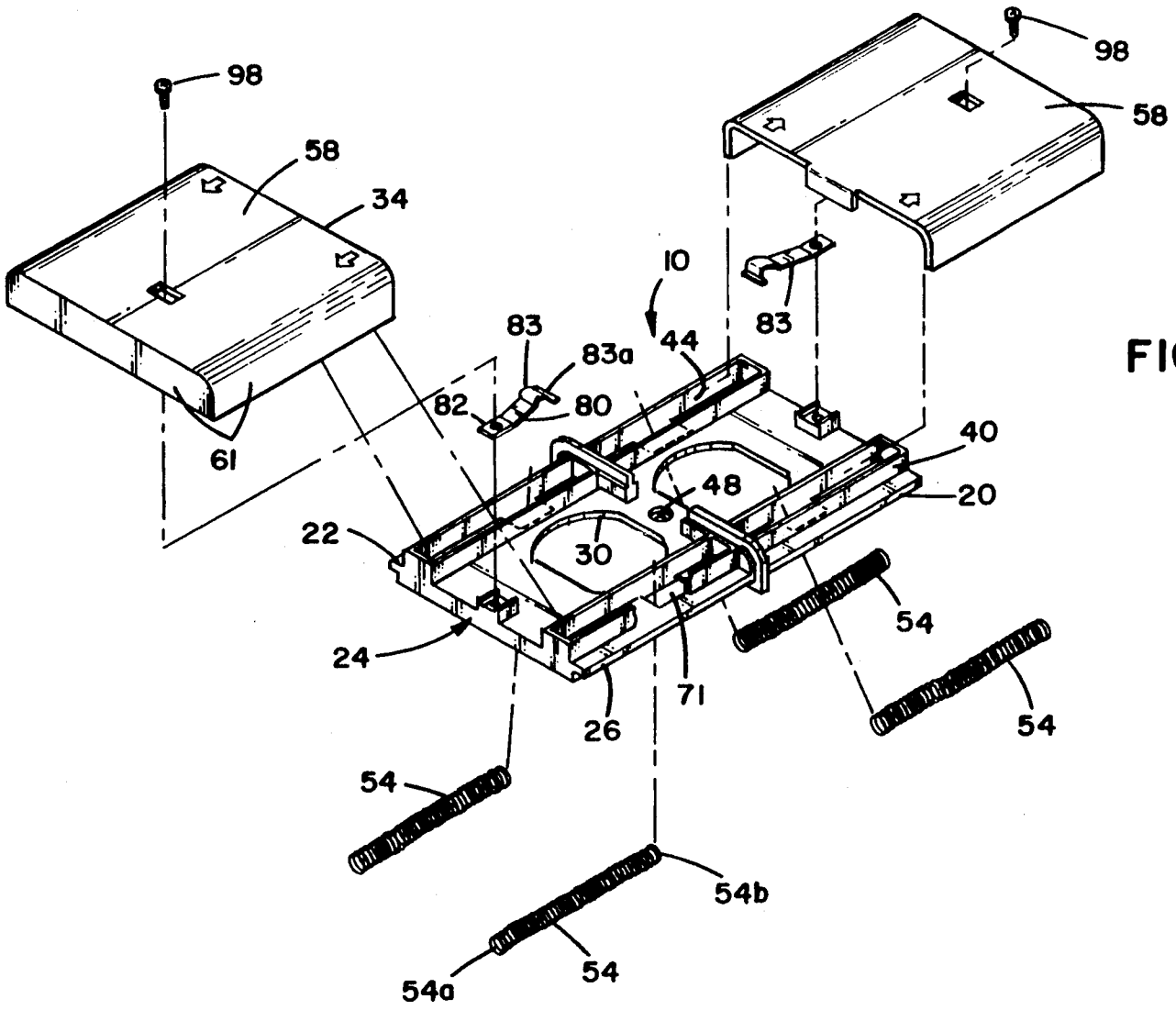
FIG. 4 is an exploded view of a slidable safety cover for electrical outlets analogous to that shown in FIG. 1.

Mounting means are provided for mounting stationary frame 20 to an electrical outlet station. A variety of mounting means may be employed, such as use of a screw or bolt conventionally attached to the previously installed electrical outlet cover, adhesive backing applied to a portion of stationary frame rear surface 24, or various other mounting means. Preferred mounting means comprises use of a bolt or screw member 46 inserted through mounting aperture 48, as shown in FIG. 1 and FIG. 4.

Preferred slidable safety cover 10 comprises channel means comprising a plurality of parallel sidewalls 40 which are constructed and arranged along front surface 22 to provide convenient locations for placing a biasing means. Various biasing means may be used within the spirit of this invention, however, preferred biasing means comprises spring means 54. As illustrated in FIG. 4, spring means 54 may comprise a plurality of springs when slidable safety cover 10 is utilized for multiple electrical outlets and to achieve balanced slidable motion of slidable cover member 34. Indeed, preferred spring means 54 comprises use of at least one helical compression spring. Thus, biasing means comprising spring means 54 and more preferably comprising a plurality of helical compression springs is shown in FIG. 3 positioned within a plurality of elongate channels 44 in both compressed and extended positions corresponding to opened and closed positions of slidable cover member 34.

Numerous possible configurations of biasing means positioned for use with a slidable component means is known within the field of slidable safety covers for electrical outlets. However, preferred biasing means according to the present invention comprises spring means positioned in the channel means for biasing slidable component means on stationary frame 20. More particularly, slidable component means is constructed and arranged for selective slidable movement parallel to sidewalls 40 defining elongate channel 44. Slidable component means preferably moves between an open position, shown in the upper portion of FIG. 3, at which access to electrical outlet 14 is available through safety cover 10, and a closed position, shown in the lower portion of FIG. 3, at which access to electrical outlet 14 is blocked. Preferred slidable component means comprises at least one slidable cover member 34 having a top surface 58, an inner surface 59, and side surfaces 61. In order to provide optimum cooperation between stationary frame 20 and slidable cover member 34, structure is provided to permit slidable connection between the two members Preferred slidable safety cover 10 comprises slidable cover member 34 comprising a plurality of side surfaces 61 comprising substantially laterally extending opposing guide lip surfaces 63 constructed and arranged for slidable contact with stationary frame rear surface 24 preferably along guide surface flange means 26.

In order to provide means for operatively connecting slidable cover member 34 with spring means 54, structure is provided and arranged as part of slidable cover member 34 against which spring means 54 may bias. A number of structural options are available, however, preferred slidable cover member 34 inner surface 59 comprises at least one positioning tab 64 constructed and arranged for slidable fit within the channel means adjacent the biasing means so that the biasing means applies force against positioning tab 64 to normally bias slidable cover member 34 toward the closed position.

The structure of the preferred arrangement of spring means 54, stationary frame 20, and slidable cover member 34 comprises features heretofore not shown in other safety cover devices. What is provided, therefore, is an improved slidable safety cover for use with electrical outlets in which at least one slidable cover member 34 is movably mounted to front surface 22 of apertured stationary frame 20 overlaying an electrical outlet 14 location and in which the slidable cover member 34 is movable between an open position and a normally biased closed position. The movement of slidable cover member 34 from the closed position to the open position requires release of a locking mechanism, which will be later discussed herein, and application of a force to slidable cover member 34 to overcome the force normally biasing slidable cover member 34 to the closed position. One improvement of the present invention comprises an apertured stationary frame 20 having a front surface 22 comprising a plurality of parallel walls or sidewalls 40 extending from and preferably normal to the plane of front surface 22 and arranged generally longitudinally along front surface 22 to provide at least one elongate channel 44 constructed and arranged to receive biasing means, such as spring means 54, in elongate channel 44 through a stationary frame aperture comprising a spring loading aperture 70 with spring loading aperture sidewalls 71 extending into the at least one elongate channel 44. This construction permits ready insertion of spring means 54 into an already assembled stationary frame 20 and slidable cover member 34. In addition to ease of assembly, this structure does not rely on tacking down or screwing in place any biasing means and employs only the existing structure of stationary frame 20 and slidable cover member 34 to retain the biasing means, or spring means 54, in place.

This configuration also provides for maintaining protective cover over the biasing means during operation of the slidable safety cover, e.g., no tampering with the biasing means is possible by children or others when slidable safety cover 10 is mounted to an electrical outlet station. Conversely, any need for ready removal, repair, or replacement of the biasing means is met by simply removing slidable safety cover 10 from a mounting in overlaying relation to an electrical outlet station and accessing the back of slidable safety cover stationary frame 20 at the one or several spring loading apertures 70. Then, by positioning the appropriate slidable cover member 34 to align end portion 54*a* or 54*b* of spring means for removal through spring loading aperture 70, the necessary removal, repair, or replacement is easily accomplished.

Preferred slidable safety cover 10 comprises a locking mechanism which provides means for maintaining slidable cover member 34 in a closed and locked position unless selective and particular unlocking forces are imparted to various portions of slidable cover member 34. In particular, slidable cover member 10 preferably comprises a locking mechanism having at least one resilient finger latch member 80 fully illustrated in FIG. 2 and FIG. 4. Resilient finger latch member 80 comprises a first portion 82 anchored to front surface 22 of stationary frame 20, and a second portion 83 shaped to partially protrude through slidable cover member 34 at a finger latch opening 88. Preferably, finger latch opening 88 is not located along or immediately adjacent to any of the slidable cover member side surfaces 61 but rather is located substantially centrally in the area comprising that portion of slidable cover member 34 laying in a plane parallel to the planar surface of stationary frame front surface 22 or rear surface 24. In other words, finger latch opening 88 is positioned as shown in FIGS. 1–4 in a front facing central area generally defined as comprising the area located at a distance of at least approximately 20 millimeters from any one of the slidable cover member side surfaces 61. As will be further appreciated, this is helpful in providing distance separation from a side surface to prevent convenient combining of force in one finger movement to disengage the locking mechanism while simultaneously using the same disengaging force to pull down against the force of biasing means tending to maintain slidable cover member 34 in a closed position. This feature may thus be viewed as an adult interlock which prevents unauthorized opening by children due to their relative lack of strength and adroitness with fingers or other limbs as compared with adults. By complicating the opening process, or making the opening process more non-ergonomic for youngsters, the slidable safety cover effectiveness is increased.

In addition to locating finger latch opening 88 substantially away from slidable cover member side surfaces 61, the minimization of the operable size of finger latch opening to an area measuring less than approximately 35 square millimeters reduces the available gripping surface for an operator attempting to unlock and open slidable cover member 34. This further contributes to discouraging tampering and possible opening by children. It is recognized, however, that as the effective surface area, size, and shape of resilient finger latch member second portion 83 is altered, the size and shape of finger latch opening 88 may be altered appropriately and in accordance with the present invention. Thus, a locking mechanism is provided comprising at least one resilient finger latch member 80 shaped with a second end portion 83 partially protruding through slidable cover member finger latch opening 88 when the slidable component means is in the closed position so that the slidable component means is immovable. Similarly, resilient finger latch 80 is constructed and arranged so that when resilient finger latch second end portion 83 is depressed and the force of the biasing means against positioning tab 64 is exceeded or overcome, then the locking mechanism is released to permit slidable movement of the slidable component means to the open position For example, an improved slidable safety cover 10 for use with electrical outlets 14 in which at least one slidable cover member 34 having an outlet-covering top surface 58 and side surfaces 61 is provided. The slidable cover member 34 is movably mounted to an apertured stationary frame 20 overlaying an electrical outlet location or station, with slidable cover member 34 movable between an open position at which access to underlaying electrical outlets is available through slidable safety cover 34 in a closed position at which access to electrical outlets 14 is blocked by slidable cover member 34. In this structure, movement of slidable cover member 34 from the closed position to the open position requires release of a locking mechanism wherein one improvement comprises a locking mechanism actuable from a location distal from all side surfaces 61 of the safety cover slidable cover member 34. Yet another improvement over prior art slidable safety covers comprises a slidable safety cover 10 as described above having a locking mechanism comprising at least one resilient finger latch member 80 having a first end portion 82 anchored to stationary frame 20 and a second end portion 88 partially or even fully protruding through slidable cover member 34 through finger latch opening 88 in slidable cover member 34 located distal from all side surfaces 61 of safety cover 10 slidable cover member 34. Yet another improvement over prior art slidable safety covers comprises a slidable safety cover 10 as described herein wherein the improvement comprises a locking mechanism comprising at least one resilient finger latch member 80 constructed and arranged for protruding through a finger latch opening in slidable cover member 34 top surface 58 in a locked position and for requiring substantially simultaneous tridexterous hand and finger movements to impart force to the locking mechanism and slidable cover member 34 in three substantially perpendicular directions to depress and release the locking mechanism and to grip and to move slidable cover member 34 to an open position.

Referring to FIG. 2, a preferred resilient finger latch member 80 is shown in a side section elevational view. FIG. 2 shows resilient finger latch member 80 positioned in a locked position with second end portion 83 partially extending or protruding through finger latch opening 88 to prevent slidable movement of slidable cover member 34 to an open position, said direction being represented by direction arrow labeled J—J. Preferred resilient finger latch member 80 may be constructed of any suitable material providing resilient and durable structure to operate in slidable safety cover 10. A most preferred slidable safety cover 10 comprises resilient finger latch member 80 constructed of material selected from the group consisting of metal, plastic, wood, and rubber. As illustrated in FIG. 2, the ideal structure of resilient finger latch member 80 comprises a shaped metal resilient finger latch member 80 mounted by anchoring means to stationary frame 20. Various anchoring means may be employed, however, preferred anchoring means comprises at least one anchoring screw 98.

Yet another advantage of the shape and structure of the locking mechanism according to the present invention comprises a substantially planar relationship between top surface 58 and resilient finger latch member 80 second end portion 83 extending through finger latch opening 88. In other words, the amount of protrusion through finger latch opening 88 is very minor and that portion of finger latch member 80 extending through finger latch opening 88 is either substantially coplanar with top surface 58 or extends only a very small amount above the plane of top surface 58 (just enough to be depressible beyond the thickness of slidable cover member 34 surrounding finger latch opening 88) in a generally flush configuration so as to discourage ready manipulation and depression of second end portion 83 by children. Also, the generally flush nature and shape of protruding second end portion 83 of resilient finger latch member 80 provides additional safety to children with regard to any hazard presented by less blunt protrusions common on other devices which may lead to undue scratching or poking of sensitive skin of children. Along those lines, FIG. 2 further illustrates the function and operation of retaining surface 83*a* which optionally abuts slidable cover member 34 inner surface 59 to prevent full extension of second end portion 83 through finger latch opening 88 in an undesired manner.

Thus, the operation of slidable safety cover 10 provides means for normally biased closed positioning over electrical outlets 14 to provide enhanced personal safety for children or others near the outlets. Preferred slidable safety cover 10 further comprises non-ergonomic means for discouraging and preventing opening of slidable safety cover 10 by children or other unauthorized individuals. This is accomplished by the novel configuration of slidable cover members 34 in cooperation with biasing means and a preferred locking mechanism arrangement. Referring to FIG. 1, it may now be illustrated how various force vectors must be applied in order to readily open slidable safety cover 10 in a balanced manner, e.g., a manner not applying excessive and possibly damaging force in any one or two directions. As shown in FIG. 1, a first force labeled F′ must be applied against resilient finger latch member 80 second end portion 83 through slidable cover member 34 finger latch opening 88. Substantially simultaneous with application of force F′, a second force labeled F″ must be applied preferably to side surfaces 61 to provide gripping force to grip slidable cover member 34 sufficient to apply a third force. Third force, labeled F‴, must then be applied to slidable cover member 34 in a direction to overcome the force of biasing means normally biasing slidable cover member 34 to a closed position. Thus, it may be appreciated that an individual capable of applying only one or possibly two of the above-described three forces will probably be unsuccessful in opening or overriding the locking mechanism described by this invention. Rather, only one possessing the dexterity normally possessed by competent adults or adolescents will be successful in operating the locking mechanism. The resulting improvements in safety and deterrence of hazardous child tampering provides an improved slidable safety cover 10 which also comprises substantially simplified manufacturing and assembly processes as compared with prior art devices of more complex structure.

The invention accordingly consists in the features of the construction, combinations of elements, arrangements of parts, and methods of manufacture which will be exemplified in the construction and methods described above and of which the scope of the invention would be indicated in the following claims. It is to be understood that while certain embodiments of the present invention have been illustrated and described, the invention is not to be limited to the specific forms or arrangements of parts herein described and shown.

What is claimed is:

1. A slidable safety cover for electrical outlets, comprising:

a) a stationary frame for installation around an electrical outlet comprising a front surface and a rear surface, the stationary frame front surface and rear surface defining apertures extending through the stationary frame for permitting access to electrical outlets therethrough;

b) biasing means positioned on the stationary frame for biasing slidable component means;

c) slidable component means constructed and arranged for selective slidable movement on the stationary frame between an open position at which access to the electrical outlets is available through the slidable safety cover and a closed position at which access to the electrical outlets is blocked; the slidable component means comprising at least one slidable cover member inner surface comprising at least one positioning tab constructed and arranged for contact by the biasing means so that the biasing means applies force against the positioning tab to normally bias the slidable cover member toward the closed position; and the slidable cover member inner surface and outer surface defining an aperture therethrough comprising a finger latch opening located between the side surfaces., and d) a locking mechanism comprising at least one resilient finger latch member having a first end portion anchored to the front surface of the stationary frame and a second end portion shaped to partially protrude through the slidable cover member finger latch opening when the slidable component means is in the closed position so that the slidable component means is immovable; the resilient finger latch also being constructed and arranged so that when the resilient finger latch is depressed and the force of the biasing means against the positioning tab is overcome then the locking mechanism is released to permit slidable movement of the slidable component means to the open position.

2. A slidable safety cover according to claim 1 wherein the biasing means comprises spring means.

3. A slidable safety cover according to claim 2 wherein the spring means comprises a helical compression spring.

4. A slidable safety cover according to claim 1 wherein said slidable component means include two slidable cover members each having a side surface, wherein the respective slidable cover member side surfaces comprise laterally extending opposing guide lip surfaces constructed and arranged for slidable contact with the stationary frame rear surface to retain the slidable cover member in contact with the stationary frame.

5. A slidable safety cover according to claim 1 wherein the slidable cover member finger latch opening comprises an open area measuring less than approximately 35 square millimeters.

6. A slidable safety cover according to claim 1 wherein the slidable cover member finger latch opening is located at a distance of at least approximately 20 millimeters from any one of the slidable cover member side surfaces.

7. A slidable safety cover according to claim 1 wherein the resilient finger latch member is constructed of material selected from the group consisting of metal, plastic, wood, and rubber.

8. An improved slidable safety cover for use with electrical outlets in which at least one slidable cover member having an outlet-covering top surface and side surfaces is movably mounted to an apertured stationary frame overlaying an electrical outlet location and in which the slidable cover member is movable between an open position at which access to underlaying electrical outlets is available through the slidable safety cover and a closed position at which access to the electrical outlets is blocked by the slidable cover member top surface, and in which the movement of the slidable cover member from the closed position to the open position requires release of a locking mechanism, wherein the improvement comprises a locking mechanism actuable from a location removed form all side surfaces of the safety cover slidable cover member, wherein the locking mechanism includes a latch member which can engage the slidable cover member when the slidable cover member is in the closed position, said slidable cover member having a latch member access opening in the top surface thereof through which the latch member can be actuated.

9. An improved slidable safety cover for use with electrical outlets in which at least one slidable cover member having an outlet-covering top surface and side surfaces is movably mounted to an apertured stationary frame overlaying an electrical outlet location and in which the slidable cover member is movable between an open position at which access to underlaying electrical outlets is available through the slidable safety cover and a closed position at which access to the electrical outlets is blocked by the slidable cover member top surface, and in which the movement of the slidable cover member from the closed position to the open position requires release of a locking mechanism, wherein the improvement comprises a locking mechanism comprising at least one resilient finger latch member having a first end portion anchored to the stationary frame and a second end portion partially protruding through the slidable cover member through a finger latch opening in the slidable cover member top surface, said finger latch opening being located distal from all side surfaces of the safety cover slidable cover member.

10. An improved slidable safety cover for use with electrical outlets in which at least one slidable cover member having an outlet-covering top surface and side surfaces is movably mounted to an apertured stationary frame overlaying an electrical outlet location and in which the slidable cover member is movable between an open position at which access to underlaying electrical outlets is available through the slidable safety cover and a normally closed and biased position at which access to the electrical outlets is blocked by the slidable cover member top surface, and in which the movement of the slidable cover member from the closed position to the open position requires release of a locking mechanism and movement of the slidable and biased cover member, wherein the improvement comprises a locking mechanism comprising at least one resilient finger latch member constructed and arranged for partially protruding through a finger latch opening in the slidable cover member top surface in a locked position and for requiring substantially simultaneous tri-dexterous hand and finger movements to impart force to the locking mechanism and the slidable cover member in three perpendicular directions to depress and release the locking mechanism and to grip and move the slidable cover member to an open position.

11. A slidable safety cover for electrical outlets, comprising:

a) a stationary frame for installation around an electrical outlet comprising a front surface and a rear surface, the stationary frame front surface and rear surface defining apertures extending through the stationary frame for permitting access to electrical outlets therethrough; the front surface comprising channel means comprising a plurality of parallel sidewalls extending normal to the plane of the front surface and arranged longitudinally along the front surface to provide at least one elongate channel;

b) mounting means for mounting the stationary frame to an electrical outlet station;

c) biasing means positioned in the channel means for biasing slidable component means located partially within the channel means adjacent the biasing means;

d) slidable component means constructed and arranged for selective slidable movement parallel to the channel means sidewalls between an open position at which access to the electrical outlets is available through the safety cover and a closed position at which access to the electrical outlets is blocked; the slidable component means comprising at least one slidable cover member having an outer surface, an inner surface, and side surfaces; the slidable cover member inner surface comprising at least one positioning tab to normally bias the slidable cover member toward the closed position; and the slidable cover member inner surface and outer surface defining an aperture therethrough comprising a finger latch opening located between the side surfaces; and e) a locking mechanism comprising at least one resilient finger latch member having a first end portion anchored to the front surface of the stationary frame and a second end portion shaped to partially protrude through the slidable cover member finger latch opening when the slidable component means is in the closed position so that the slidable component means is immovable; the resilient finger latch also being constructed and arranged so that when the resilient finger latch second end portion is depressed and the force of the biasing means against the positioning tab is overcome then the locking mechanism is released to permit slidable movement of the slidable component means to the open position.

* * * * *